US005955957A

United States Patent [19]

Calabrese et al.

[11] Patent Number: 5,955,957

[45] Date of Patent: Sep. 21, 1999

[54] FOOTWEAR WITH ELECTROLUMINESCENT WIRE

[76] Inventors: Stephen Calabrese, 126 Grand Ave., Leonia, N.J. 07605; Daniel T. Moore, 290 Hillside Ave., Livingston, N.J. 07039

[21] Appl. No.: 08/944,749

[22] Filed: Oct. 6, 1997

Related U.S. Application Data

[60] Provisional application No. 60/049,815, Jun. 17, 1997.

[51] Int. Cl.[6] ..... G08B 3/00

[52] U.S. Cl. ..... 340/691; 340/573; 340/665; 33/3 A; 36/137; 362/103

[58] Field of Search ..... 340/323 R, 573, 340/665, 666, 691, 693; 33/3 R, 3 A, 3 B, 3 C; 36/136, 137; 362/84, 103

[56] References Cited

U.S. PATENT DOCUMENTS 5,343,190 8/1994 Rodgers ..... 340/573
5,611,621 3/1997 Chien ..... 362/103
5,720,121 2/1998 Barker ..... 36/137
5,746,500 5/1998 Chien ..... 362/103

*Primary Examiner*—Daniel J. Wu
*Attorney, Agent, or Firm*—Richard A. Joel, Esq.

[57] ABSTRACT

This invention comprises footwear having a power source and switching mechanism mounted in the heel under padding and an electroluminescent wire mounted in a predetermined position on the footwear to provide illumination. The electroluminescent wire comprises a thin linear light source wherein light is produced by activating an electroluminescent phosphor with high alternating electric current. The phosphor is located between two electrically conductive wires, one in the core or center of the phosphor layer and one on the outside of the phosphor layer with spirals about the wire. The electroluminescent wire is connected to a control circuit for converting the battery power to alternating current. When an individual applies force to the bottom of the footwear or motion, a vibration sensitive switch activates the circuit causing the electroluminescent phosphor to become lighted. The wire may be positioned along the out sole inside and outside or along the tongue or other position on the footwear.

10 Claims, 5 Drawing Sheets

10
38
28
27
24
20
23
11
37
12
26
31
25
29

38
30
10
20
20
11
12

FOOTWEAR WITH ELECTROLUMINESCENT WIRE

This application claims benefit of provisional application 60/049,815 filed Jun. 17, 1997.

BACKGROUND OF THE INVENTION

The concept of illuminated footwear has its origin both in the desire for style and the desire for safety. With millions of joggers, the use of footwear which is illuminated either constantly or periodically, is a definite safety consideration. The attractiveness and novelty of such footwear make it a large potential seller.

In the prior art, various means have been utilized to illuminate footwear such as light emitting diodes coupled to light pipes and even bulbs activated by batteries and switches to illuminate a portion of the shoe. Applicant, however is proposing a new and improved means for illuminating a specific portion of the footwear whether it be the sole or the tongue or the heel or for that matter any other shoe part. A unique vibration sensitive switch activates a circuit which causes an electroluminescent wire to flash. The wire is mounted on the footwear in a predetermined design so that the abrupt change in voltage from the switch illuminates the wire.

The prior art has experienced problems in the quality of the illumination and the fact that the devices often broke down. This has been resolved by the excellent illumination provided by the present invention and the fact that the electroluminescent wire and circuit used herein is sturdy and may readily be incorporated in many designs. Thus, the invention discloses an inexpensive and reliable means to illuminate footwear.

SUMMARY OF THE INVENTION

This invention relates to footwear and particularly to footwear which is illuminated.

The invention comprises footwear such as a sneaker wherein the power supply is mounted in the heel. The power supply includes a switch or transducer which is coupled to batteries and activates an electroluminescent wire. The wire may be activated by periodically closing a switch or upon operation of a transducer when the footwear contacts the ground.

The electroluminescent wire comprises a core wire having a layer of an electroluminescent phosphor surrounding the core wire and an external conductive wire spirally wound about the phosphor layer. Light is produced in the wire by supplying an alternating current to the conductive wires. The result is a highly attractive illuminated design which is sturdy, inexpensive and flexible in that it can be readily mounted anywhere in the footwear to provide various designs. Existing lighted footwear depends on different technology which provides a less durable and less attractive lighting system.

In operation, the footwear portion including the electroluminescent wire, is activated when the sneaker hits the ground, closing a switch or operating a transducer to cause an abrupt change in voltage triggering a monostable multivibrator. The output signal is fed to an oscillator which produces a train of square pulses supplied to a semiconductor switch. The switch output is fed to a transformer which provides a series of high voltage pulses to the electroluminescent wire. The phosphor portion of the wire lights up in the particular selected color and in a predetermined design arrangement.

Accordingly, an object of this invention is to provide new and improved illuminated footwear.

Another object of this invention is to provide new and improved illuminated footwear including an electroluminescent wire.

A further object of this invention is to provide a new and improved illuminated footwear including an electroluminescent wire having a phosphor layer mounted over a core wire and having a spirally wound outer wire wrapped thereabout to activate the phosphor.

A more specific object of this invention is to provide a new and improved sneaker having a power supply and control circuit mounted in the heel thereof and an electroluminescent wire mounted in a predetermined design on the sneaker having a core wire, a phosphor layer and spirally wound outer layer which activate the phosphor when high voltage pulses are applied to the wire by actuation of a vibration sensitive switch which triggers the control circuit to supply power to the wire.

BRIEF DESCRIPTION OF THE DRAWINGS

The above and other objects and advantages of this invention may be more clearly seen when viewed in conjunction with the accompanying drawings wherein.

DETAILED DESCRIPTION OF THE INVENTION

Figure 1:
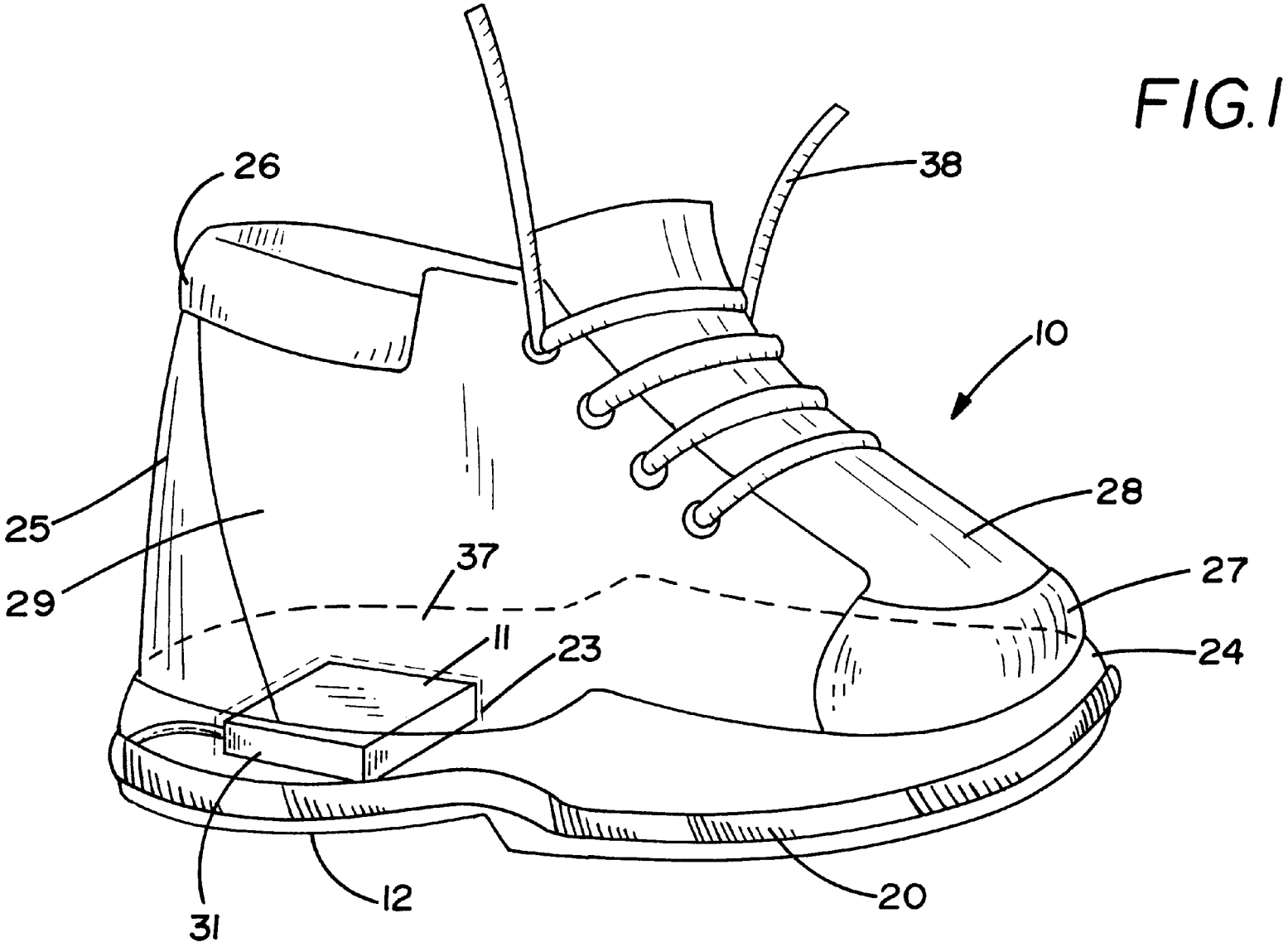
FIG. 1 is a perspective view of footwear incorporating the invention along the outsole.
Figure 2:
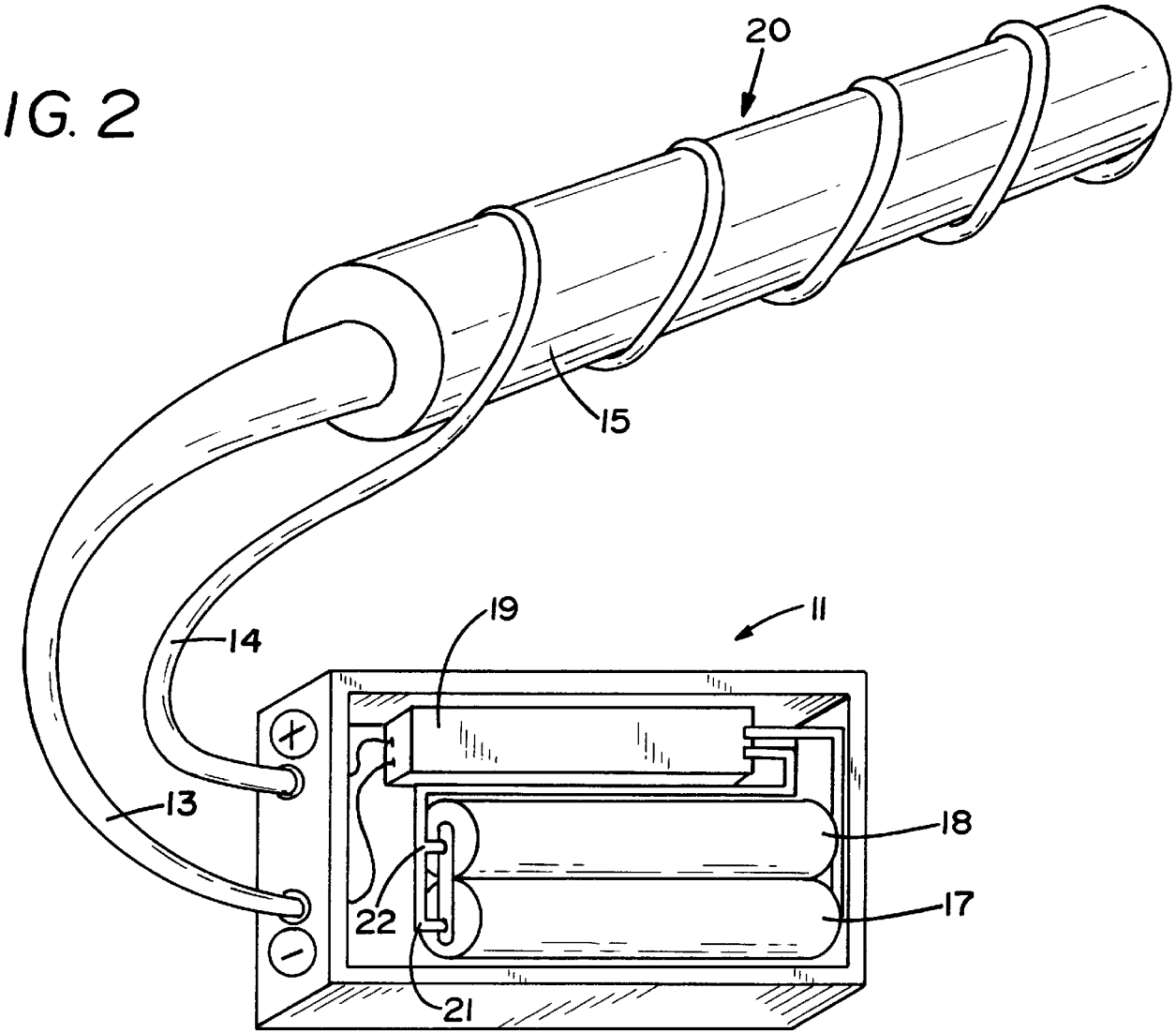
FIG. 2 is a perspective view of the electroluminescent wire connected to the control box.

Referring now to the drawings and particularly FIG. 1, the invention comprises footwear such as a sneaker 10 which includes a power supply 16 and control circuit 19 mounted within a box 11. The control box 11 is located in a recess in the heel 12 of the sneaker 10 with appropriate padding positioned thereover. The box 11 is connected to core wire 13 and wire 14 which is spirally wound about a layer 15 of electroluminescent phosphor which surrounds the core wire 13. The combination of wires 13 and 14 and layer 15 are designated as 20 and termed the electroluminescent wire 20, see FIG. 2.

The power supply 16 comprises a pair of replaceable batteries 17 and 18 which are connected to a control circuit 19 by wires 21 and 22. The control circuit 19 includes a switch 40 or transducer to activate the electroluminescent wire 20 periodically and/or a switching and timing circuit to periodically activate the wire 20 either on a time basis or as the foot strikes the ground. On the other hand, it may be desirable to maintain the wire 20 in a permanently illuminated condition. The control circuit 19 converts the battery output to AC current in converter 35. This AC current activates the electroluminescent wire 20.

Figure 5:
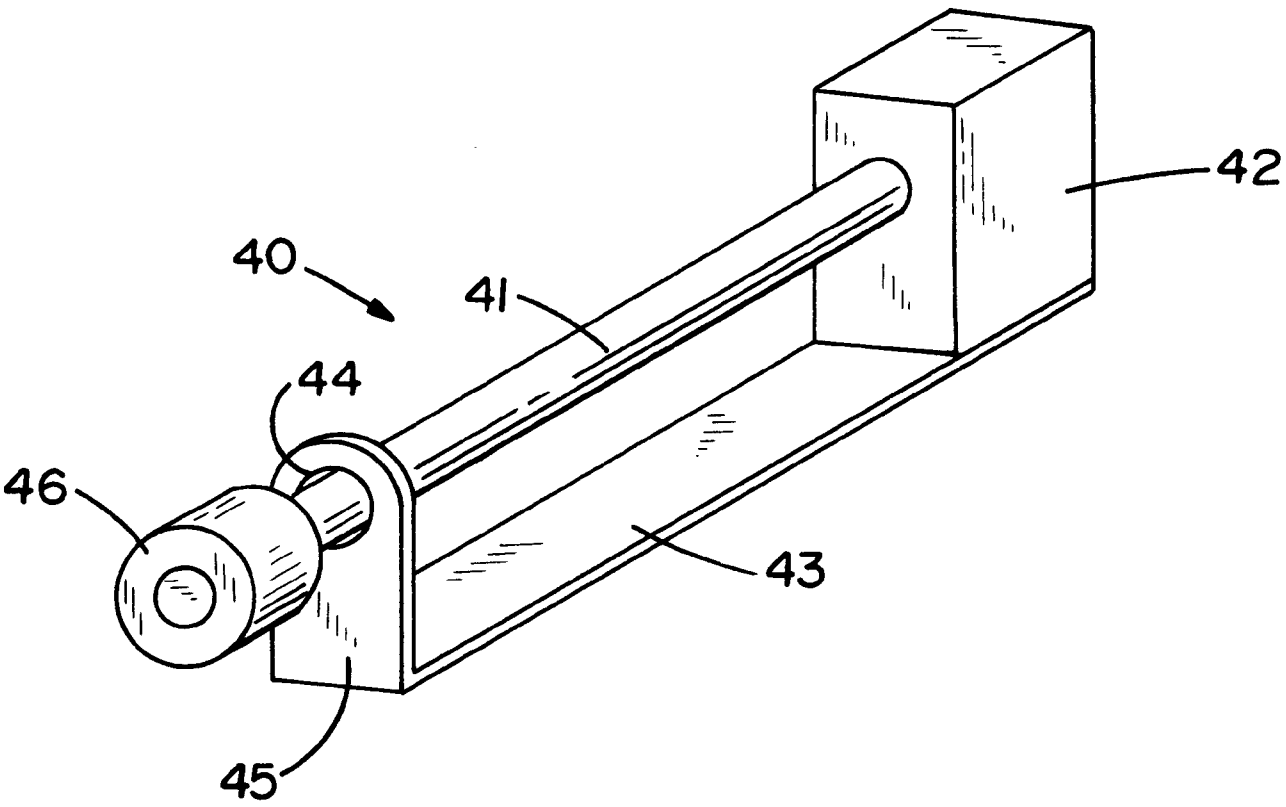
FIG. 5 is a perspective view of the switch which activates the circuit.

More specifically as shown in FIG. 5, the switch 40 comprises a spring wire 41 cantilevered from a non-conductive support 42 mounted on a conductive bracket 43. The wire 41 extends through an aperture 44 in an upwardly extending portion 45 of the bracket 43 and includes a mass 46 mounted on the end thereof. Any motion of the footwear 10 causes contact between the spring wire 41 and the bracket 43. This brief contact causes a momentary electrical pulse which is captured by the glitch portion 47 of the circuit. The design is to convert the low DC voltage of the batteries 17 and 18 into a short burst of high AC voltage to power the electroluminescent wire 20.

Figure 4:
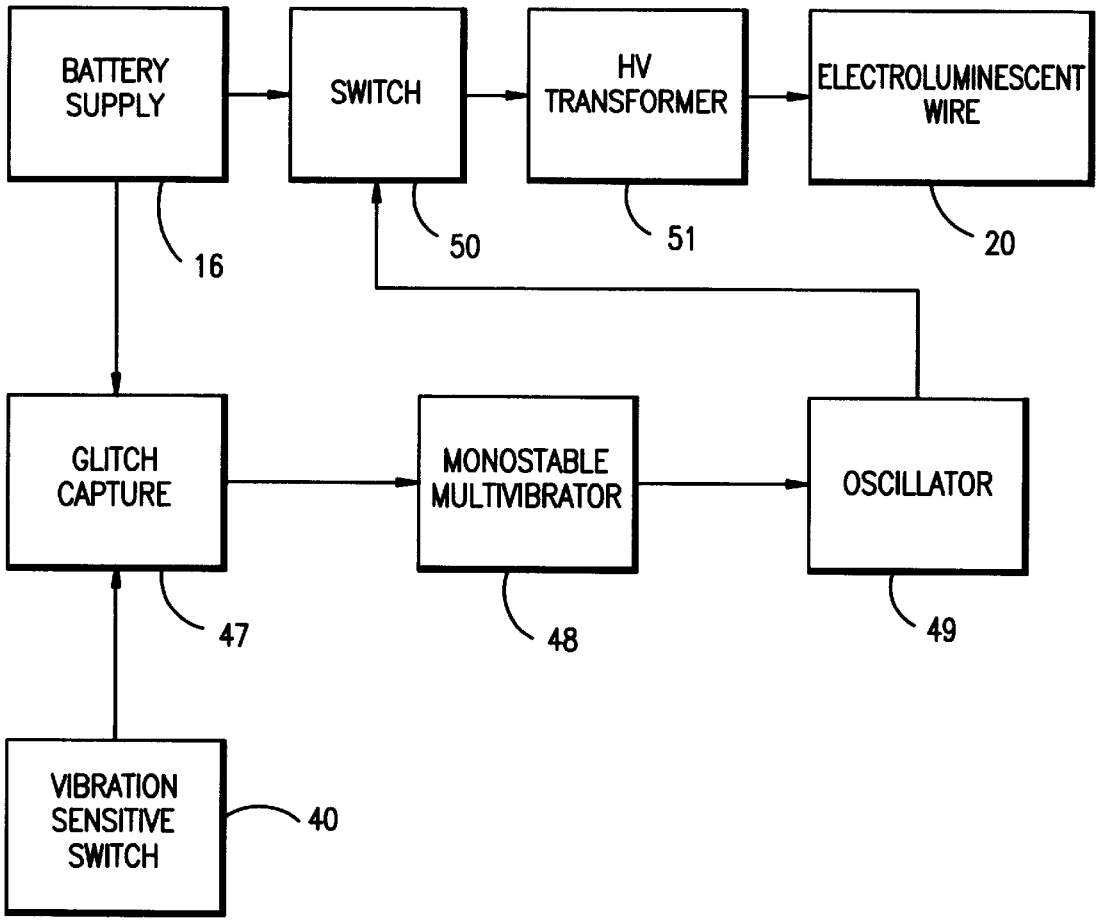
FIG. 4 shows a block diagram for the circuit of the invention.

In operation, the battery supply 16 provides electrical current to the entire circuit, see FIG. 4. When a slight movement is made, the normally open vibration sensitive switch 40 briefly closes, thus, causing an abrupt change in voltage. The glitch capture 47 senses this change and triggers the monostable multivibrator 48. The multivibrator's output then swings from zero voltage to near the supply voltage of the battery 16. This output signal is then held for the length of time that the electroluminescent wire 20 is to be on (approximately 100 milliseconds). The multivibrator's output signal is then directly applied to the oscillator 49. Upon receiving this signal, the oscillator 49 produces a train of square pulses at approximately 4KHz. The oscillator 49 only functions when it continues to receive the high level signal from the multivibrator 48. The oscillator's train of square pulses are applied to a semiconductor switch (i.e. Darlington transistor) 50. With each pulse, this switch 50 allows the battery current to flow through a high voltage transformer 51 and then stops it. Thus, a high voltage sinewave of approximately 300 Vpk-pk is generated at the output of the transformer 51. This voltage then directly powers the electroluminescent wire.

Figure 3:
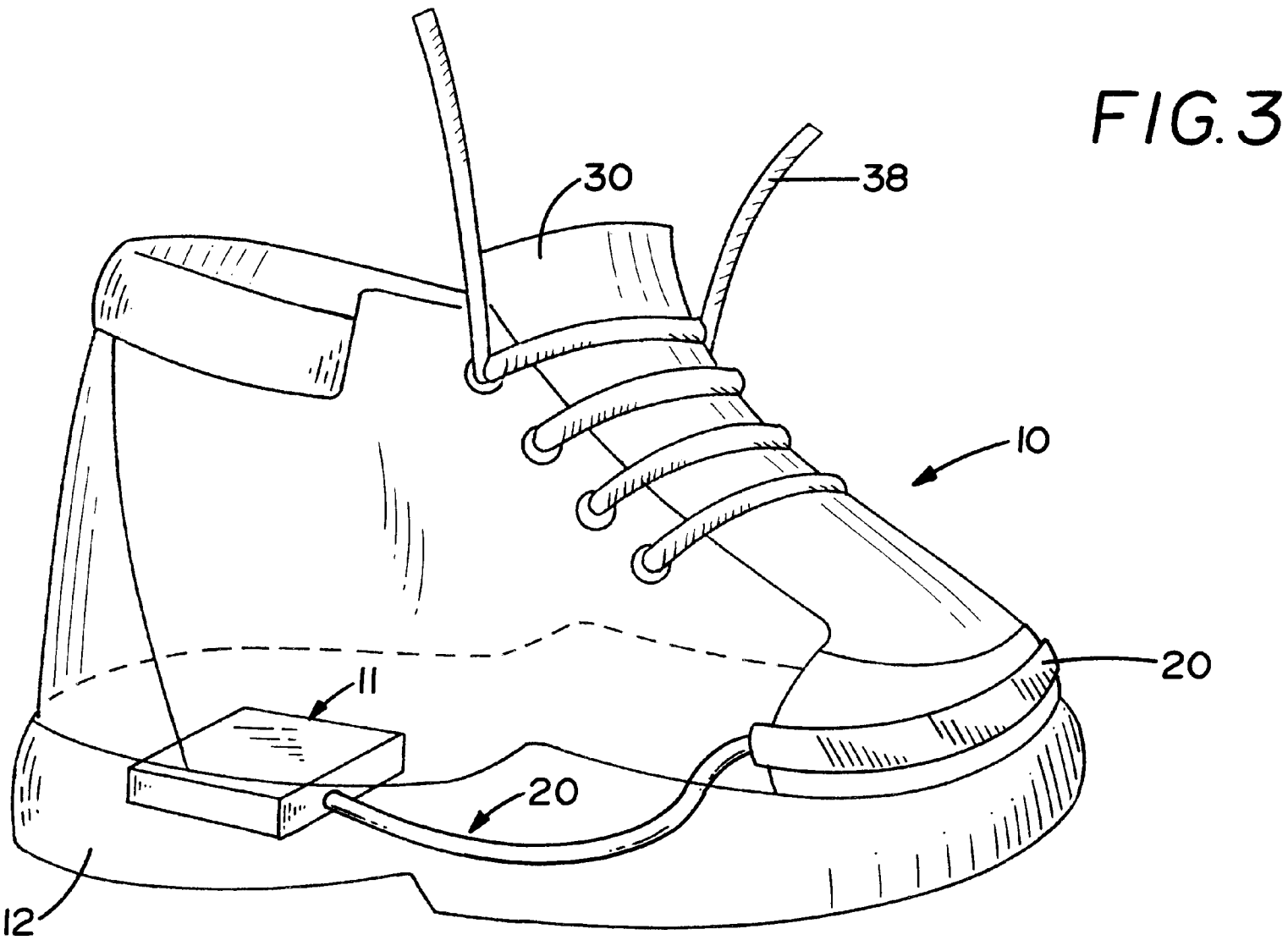
FIG. 3 shows a plurality of wires positioned on various portions of the footwear.

In a typical embodiment, see FIG. 1, the box 11 is mounted in a recess 23 in the heel 12. Removable padding 37 is placed thereover. The wire 20 is embedded in the outsole 24 which can be a translucent material. When the wire 20 is activated, the shoe 10 is outlined by the lighted wire 20 in a particular attractive color. Since the wire 20 is flexible, it may be mounted in various positions on the footwear 10. For example, the wire 20 may be mounted on the heel 12, the rear 25, the moustache 26, the toe piece 27, the vamp 28, the quarter panel 29 and/or the tongue 30. FIG. 3 depicts an alternate embodiment of the invention.

Alternatively, the wire 20 may be affixed to a Velcro tongue in various selected designs on the tongue 30. The wire 20 may also be used as shoe laces 38. The only change is that wire 20 must be run to the particular port being illuminated.

While the invention has been explained by a detailed description of certain specific embodiments, it is understood that various modifications and substitutions can be made in any of them within the scope of the appended claims which are intended also to include equivalents of such embodiments.

What is claimed is:

1. Illuminated footwear comprising:

an electroluminescent wire mounted on the footwear comprising a conductive core wire, an electroluminescent phosphor layer mounted thereover and an outer conductive wire spirally wrapped about the phosphor layer;

switching means sensitive to motion of the footwear mounted in said footwear; and, a control circuit and power supply coupled to the electroluminescent wire and activated by the switching means to cause illumination of the wire.

2. Illuminated footwear in accordance with claim 1 wherein:

the switching means comprises a spring wire having one end mounted in a support, a main body portion, and a second end cantilevered from the support and having a mass mounted thereon, a conductive support bracket having an aperture through which the body portion of the wire extends, such that motion of the footwear causes the spring wire to contact the bracket and activate the control circuit.

3. Illuminated footwear in accordance with claim 2 wherein the control includes:

a DC power supply;

a glitch capture portion connected to the switching means and activated by the abrupt change in voltage caused by brief closure of the switching means;

a multivibrator triggered by the glitch capture portion;

an oscillator connected to the multivibrator and operated by the output thereof to supply a train of square pulses;

a semiconductor switch connected to the oscillator and activated by the square pulse to provide an output; and a high voltage transformer coupled to the switch and operated thereby, said transformer being connected to the electroluminescent wire to provide power thereto illuminating said wire.

4. Illuminated footwear in accordance with claim 1 wherein:

the switching means and control circuit are mounted in the sole of the footwear.

5. Illuminated footwear in accordance with claim 1 wherein:

the electroluminescent wire is mounted about to a predetermined exterior portion of the footwear to be periodically operated upon motion of the footwear causing activation of the switching means.

6. Illuminated footwear in accordance with claim 3 wherein:

the multivibrator's output upon activation swings from zero voltage to near the power supply voltage and is held for the period of time that the electroluminescent wire is to be activated.

7. Illuminated footwear in accordance with claim 5 wherein:

the electroluminescent wire is mounted in the shoe laces.

8. Illuminated footwear in accordance with claim 5 wherein:

the electroluminescent wire is mounted on the tongue of the footwear.

9. Illuminated footwear in accordance with claim 5 wherein:

the electroluminescent wire is mounted in the heel and toe of the footwear.

10. Illuminated footwear in accordance with claim 5 wherein:

the electroluminescent wire is mounted along the sides of the footwear.

* * * * *